US008366384B2

(12) United States Patent
Södergård

(10) Patent No.: US 8,366,384 B2
(45) Date of Patent: Feb. 5, 2013

(54) PUMP ASSEMBLY AND METHOD

(75) Inventor: Bengt Södergård, Upplands Väby (SE)

(73) Assignee: Xylem IP Holdings LLC, White Plains, NY (US)

( * ) Notice: Subject to any disclaimer, the term of this patent is extended or adjusted under 35 U.S.C. 154(b) by 663 days.

(21) Appl. No.: 12/599,064

(22) PCT Filed: May 7, 2008

(86) PCT No.: PCT/SE2008/050523

§ 371 (c)(1),
(2), (4) Date: Dec. 2, 2009

(87) PCT Pub. No.: WO2008/136755

PCT Pub. Date: Nov. 13, 2008

(65) Prior Publication Data

US 2010/0143098 A1 Jun. 10, 2010

(51) Int. Cl.
*F04D 7/04* (2006.01)

(52) U.S. Cl. ..... 415/121.1

(58) Field of Classification Search ..... 415/121.1; 241/46.017, 46.08, 46.11
See application file for complete search history.

(56) References Cited

U.S. PATENT DOCUMENTS

| | | | | |
|---|---|---|---|---|
| 4,108,386 | A | 8/1978 | Conery et al. | |
| 6,471,467 | B1 * | 10/2002 | Pagalday | 415/121.1 |
| 6,746,206 | B2 | 6/2004 | Madsen et al. | |
| 7,168,915 | B2 | 1/2007 | Doering et al. | |

FOREIGN PATENT DOCUMENTS

| | | |
|---|---|---|
| EP | 0 395 604 | 10/1990 |
| WO | WO 2006/058605 | 6/2006 |

* cited by examiner

*Primary Examiner* — Richard Edgar
(74) *Attorney, Agent, or Firm* — RatnerPrestia

(57) ABSTRACT

The invention refers to a pump assembly, and more specifically to a chopping pump assembly comprising a cutting wheel mounted on a drive shaft in coaxial and co-rotational relation with a pump wheel, and a cutting plate stationary mountable in a pump housing between the cutting wheel and the pump wheel, the cutting plate having perforations forming passages there through for a liquid to be transported by the pump wheel in rotation, the cutting wheel and cutting plate in co-operation providing a shearing interface effective for cutting solid matter which may be entrained in the liquid. An axial clearance between the cutting wheel and cutting plate is established at all times by eliminating an axial play in a threaded engagement between the cutting wheel and the drive shaft. The invention also refers to a method by which an operative shearing action is securable in the pump assembly.

10 Claims, 3 Drawing Sheets

PUMP ASSEMBLY AND METHOD

This application is the U.S. national phase application of PCT International No. PCT/SE2008/050523, filed May 7, 2008, which claims priority to Swedish Patent Application No. 0701105-9, filed May 8, 2007, the contents of such patents being incorporated by reference herein.

TECHNICAL FIELD OF THE INVENTION

The present invention relates to pumps and to the assembly thereof. More specifically, the invention relates to a pump assembly comprising a cutting wheel mounted in coaxial and co-rotational relation with a pump wheel and in shearing interaction with a cutting plate arranged between the cutting wheel and the pump wheel. In accordance herewith, the invention also relates to a method by which an operative shearing action is securable in a chopping pump assembly.

BACKGROUND OF THE INVENTION AND PRIOR ART

Pumps which are adapted for the transport of liquids and slurries containing solid matter may be equipped with means arranged on the suction side of the pump for cutting solid matter which is entrained in the liquid into smaller fractions that are sized to pass through the pump. These pumps are often referred to as chopping pumps, many of which are structured as centrifugal pumps providing an axial intake flow of liquid, whereas the discharge flow is radial as seen with respect to a pump wheel.

Chopping pumps are known from the literature. For example, EP 0,395,604 A1 and U.S. Pat. No. 4,108,386 both disclose pumps having cutting impellers mounted in coaxial relation with a pump wheel and co-rotating therewith. The shearing action is provided from cutting edges arranged at a cylindrical/axial interface between the rotating impeller and a stationary ring-shaped insert which surrounds the impeller at the pump intake. In such case, the axial relation between co-operating cutting edges of the insert ring and cutting impeller is not critical to the shearing action, but rather the radial relation between these components.

WO 2006/058605 A1 discloses a chopping pump wherein shearing action is provided at a radial interface between an axial impeller, which is mounted in coaxial and co-rotational relation to a pump wheel, and the downstream side of a perforated cutting plate covering the pump intake. In such case, the shearing capacity is crucially depending on an accurate axial clearance between interacting cutting edges on the upstream end face of the impeller and on the downstream face of the intake cutting plate, respectively. To this purpose, spacer sheets need to be interposed between the intake cutting plate and the pump housing for adjustment of the axial clearance. Obviously, the adjustment is made in a final mounting step as the impeller is threaded onto the drive shaft whereby the impeller also locks the pump wheel, which has previously been keyed onto the drive shaft, in its axial position. Thus, setting of an effective shearing interaction between the axial impeller and the intake cutting plate involves the axial relation between all components, including the pump wheel.

A state of the art chopping pump is illustrated in FIG. 1 of the drawings. The chopping pump of FIG. 1 will be briefly discussed below, focusing mainly on the components that are of importance for the shearing operation.

The prior art chopping pump of FIG. 1 comprises an impeller pump wheel 1 which is journalled for rotation in a pump housing 2. The pump housing 2 has an axial intake 3 on the suction side and a radial discharge 4 on the pressure side for liquid transport effectuated by the pump wheel in rotation. Arranged co-axially with the pump wheel, and co-rotating therewith, is a cutting wheel 5. In operation, the cutting wheel rotates on the upstream side of a perforated cutting plate 6 which is stationary with respect to the pump housing. More exactly, the cutting plate 6 is bolted in covering relation with a central opening 7 that is formed through a suction plate 8, which is bolted to the pump housing at 9. Radial cutting edges 10, formed on the downstream side of the cutting wheel, co-operate in shearing interaction with edges of perforations 11 that are formed through the cutting plate. Any solid matter of some length that is sucked in through the perforations 11 is cut by the cutting wheel in relative rotation to the cutting plate.

The rotating components, i.e. the pump wheel 1 and cutting wheel 5, are carried in the end region of a drive shaft 12 which is journalled in the pump housing and is driven by a motor for rotation. The shaft 12 reaches through central bores that are formed in the pump and cutting wheels respectively. The pump wheel and cutting wheel are both non-rotationally keyed to the shaft 12 through splined connections, and are fixed axially to the shaft end by means of a locking bolt 13 which is threaded into a blind bore mouthing in the shaft's end. Evidently, setting of a proper axial clearance between the cutting wheel and the cutting plate involves the axial relation between all components, including the pump wheel.

The axial clearance between cutting wheel 5 and cutting plate 6 is established and adjusted in connection with the mounting procedure, which will now be described.

In a first mounting step the pump and cutting wheels are inserted on the shaft end, and secured axially through the locking bolt 13 while adjusting an axial clearance between the pump wheel and pump housing by means of spacer washers that are previously installed on the drive shaft 12. In a next step the suction plate 8 is bolted to the housing and adjusted with respect to a clearing distance between the pump wheel and the suction plate. Then the cutting wheel is removed by loosening the locking bolt 13, the pump wheel now able to rest on the downstream face of the suction plate. With the cutting wheel removed, the cutting plate 6 can be bolted to the suction plate 8 whereupon the cutting wheel is again installed on the shaft's end and the locking bolt is applied to re-establish the axial position of the pump and cutting wheels on the drive shaft 12. Additional spacer washers may then be necessary to install on the drive shaft, between the cutting wheel and the pump wheel, in order to provide a clearance and a degree of adjustment. The final setting of a minimum clearance between the cutting plate and the cutting wheel is performed by adjustment of the axial position of the suction plate 8, using the bolts 9 or separate set screws.

Obviously the mounting and adjustment procedure is time-wasting, and the method relying on an operator's skill to ensure a reproducible clearance at all times. But since the ability to cut down solid matter that would otherwise block the liquid intake is crucial to the chopping pump's operation, the accurate axial clearance has always to be ensured. It is thus a technical problem to improve the prior art chopping pump such that an operative axial clearance between cutting elements is always reproduced upon mounting, and by which the risk of non-proper mounting is eliminated.

SUMMARY OF THE INVENTION

It is thus an object of the present invention to improve the prior art pump such that an operative and re-producible axial clearance between cutting elements is at all times ensured upon assembly.

It is another object of the present invention to provide a pump assembly which is designed for ease of mounting, and by which the risk of non-proper mounting is eliminated.

Still another object is to provide a pump assembly wherein setting of an accurate axial clearance between components taking part in a shearing action does not affect, and is not affected by, the axial setting of the pump wheel.

These and other objects are met in a pump assembly and method as defined in the claims.

Briefly, a pump assembly according to the present invention comprises a cutting wheel mounted on a drive shaft in coaxial and co-rotational relation with a pump wheel, and a cutting plate stationary mountable in a pump housing between the cutting wheel and the pump wheel, the cutting plate having perforations forming passages there through for a liquid to be transported by the pump wheel in rotation, the cutting wheel and cutting plate in co-operation providing a shearing interface effective for cutting solid matter that may be entrained in the liquid. The pump assembly is characterized in that the cutting wheel has an internal thread engaging an external thread on the drive shaft, the pump assembly further comprises an adjusting element, which is arranged to establish an axial clearance at the shearing interface between the cutting wheel and the cutting plate by applying a separating axial force on the cutting wheel and on the drive shaft and thereby eliminating an axial play in the threaded engagement between the cutting wheel and the drive shaft.

In a preferred realization of the invention, the separating axial force is applied from a stop screw engaging the internal thread of the cutting wheel while abutting an end face of the drive shaft.

The internal thread of the cutting wheel alternatively engages a thread which is formed externally on an axial extension of the drive shaft. Said axial extension may be realized as a bolt which is insertable in the drive shaft end, and which has an external thread formed on a head of the bolt.

Also preferred, the drive shaft end may be insertable into the pump wheel for a splined connection with a blind bore formed in the pump wheel. The bolt may then be passed through a bottom of the blind bore to effect an axial securing of the pump wheel to the drive shaft end, while also serving as an extension of the drive shaft onto which the cutting wheel is mountable through a threaded engagement with the bolt head.

In brief, a method by which an operative shearing action is securable in the pump assembly comprises the step of:

- securing the pump wheel axially on the drive shaft;
- mounting the cutting plate stationary to the pump housing;
- mounting the cutting wheel in a threaded engagement with the drive shaft end so as to contact the cutting plate, and
- applying an adjusting element (22), which is arranged to establish an axial clearance at the shearing interface between the cutting wheel and the cutting plate by applying a separating axial force on the cutting wheel and on the drive shaft and thereby eliminating an axial play in the threaded engagement between the cutting wheel and the drive shaft.

Further details and advantages will be appreciated from the following detailed description of the pump assembly as applied in a centrifugal chopping pump.

BRIEF DESCRIPTION OF THE DRAWINGS

The invention will be described below with reference to the drawings, illustrating an embodiment of the invention. In the drawings.

DETAILED DESCRIPTION OF THE ILLUSTRATED EMBODIMENT

Figure 1:
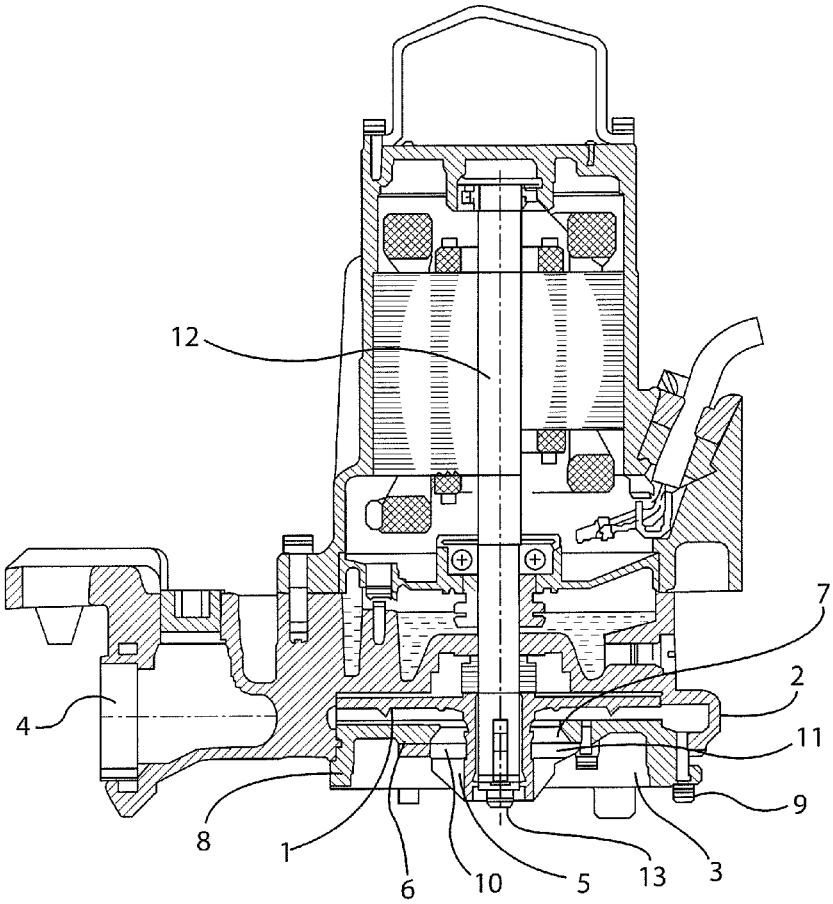
FIG. 1 (Prior Art)
FIG. 1 is a longitudinal section through a prior art chopping pump.

Referring initially to FIG. 1, the prior art chopping pump illustrated therein is best understood with reference to the written description given above. The invention is thus first illustrated in FIG. 2, wherein pump components are defined by the same reference numbers that are used in connection with the corresponding pump components of FIG. 1.

Figure 2:
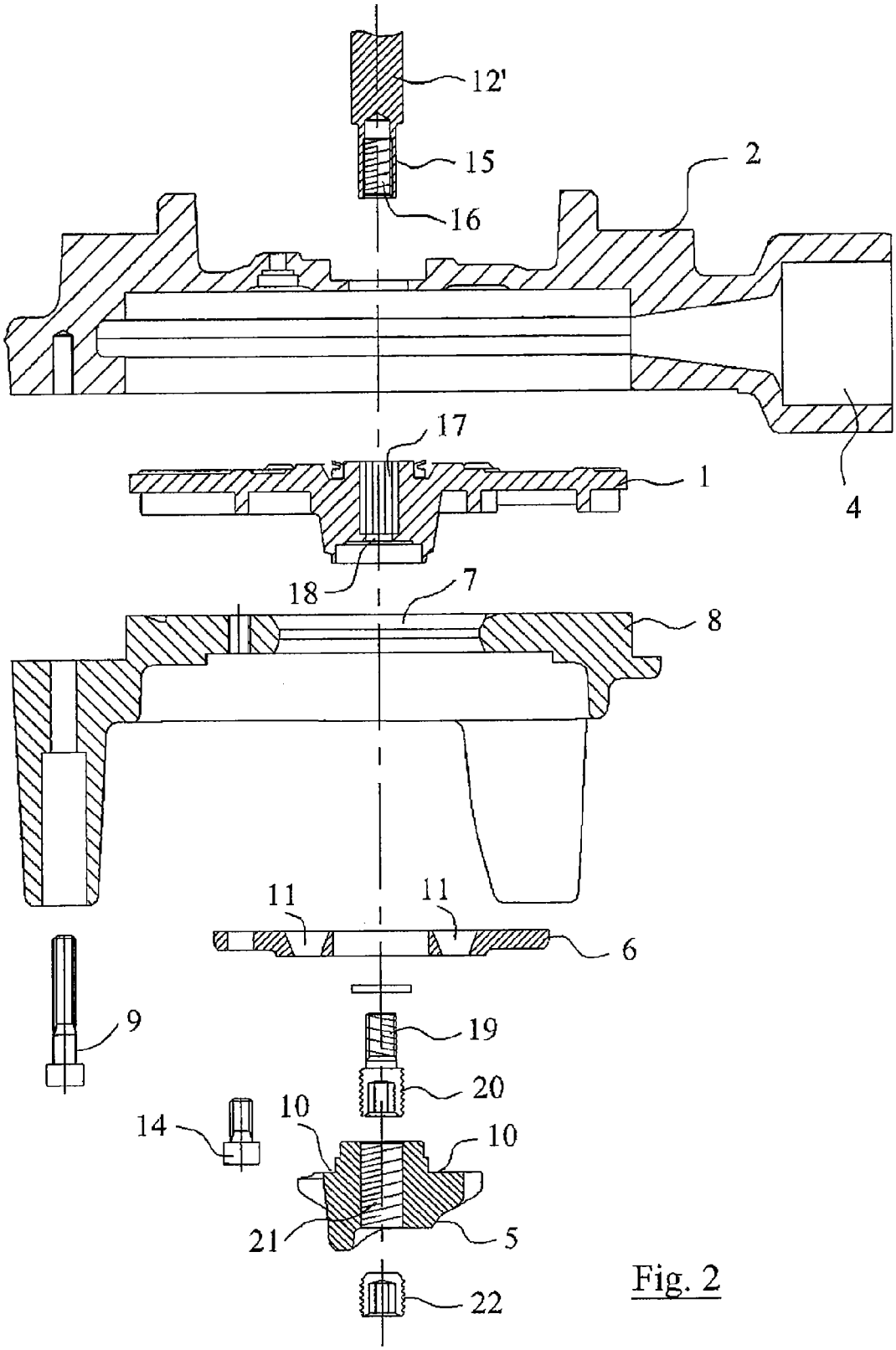
FIG. 2 is an exploded view showing the invention applied in a centrifugal chopping pump, the relevant components of which are sectioned through a common longitudinal centre.

With reference to FIG. 2, a pump housing 2 has a chamber wherein an impeller pump wheel 1 is journalled and driven for rotation. An intake opening 7 is formed through a suction plate 8 that is stationary mountable to the pump housing by means of bolts 9. In operation, as the pump wheel rotates, liquid is sucked in through the intake opening and discharged through the radial discharge 4 by centrifugal forces generated from vanes formed on the pump wheel. The operation, which is well known, is that of a typical centrifugal pump and needs no further explanation herein.

A cutting plate 6 is stationary mountable to the suction plate by means of bolts 14. In mounted position the cutting plate covers the intake opening 7 through the suction plate. Perforations 11 through the cutting plate provide passages through which liquid and moderate sized solid matter entrained in the liquid can pass into the pump chamber.

A cutting wheel 5 is mountable for rotation on the upstream side of cutting plate 6. The cutting wheel is formed with cutting edges 10 that extend substantially in radial directions from a central hub portion of the cutting wheel. The cutting edges 10 are formed in the downstream side of the cutting wheel, facing the cutting plate, and co-operate in a shearing action with the edges of cutting plate perforations 11 as the cutting wheel is driven in rotation with respect to the cutting plate.

The structure and operation of said components is so far substantially identical to that of the prior art pump. Also in correspondence with the pump of FIG. 1, the pump and cutting wheels are co-rotating and both driven for rotation by a common drive shaft. However, the rotating parts differ from the corresponding parts of the prior art pump with respect to their assembly with the drive shaft.

In contrast to the previous drive shaft 12, the drive shaft 12' does not reach axially slidable through the pump and cutting wheels. The drive shaft 12' has a shaft end 15 which is formed externally with splines. The pump wheel 1 has a central blind bore 17 with internal splines to receive the shaft end 15 in a splined connection. The shaft end 15 is fully inserted in the blind bore when the end face of the shaft end abuts the bottom of the blind bore 17. A hole 18 of lesser diameter through the bottom of the blind bore 17 admits the insertion of a bolt 19 which is threaded externally for engagement with the internal threads of a blind bore 16 which opens in the shaft's end 15. When fully inserted, the bolt 19 secures the pump wheel axially on the drive shaft. The bolt 19 is formed with a head 20 which is threaded externally, and is further provided with a seat for engagement with a tool such as an Allen key, by which the bolt may be screwed into the shaft's end. In inserted position the bolt head 20 effectively forms a threaded extension of the drive shaft 12'.

The cutting wheel 5 has a central through bore 21 which is threaded internally, and by which the cutting wheel can be screwed down over the bolt head 20 in a threaded engagement. A stop screw 22 or adjusting element, which in the preferred embodiment is externally threaded, is insertable from the opposite end of central bore 21 in threaded engagement with the cutting wheel.

Figure 3:
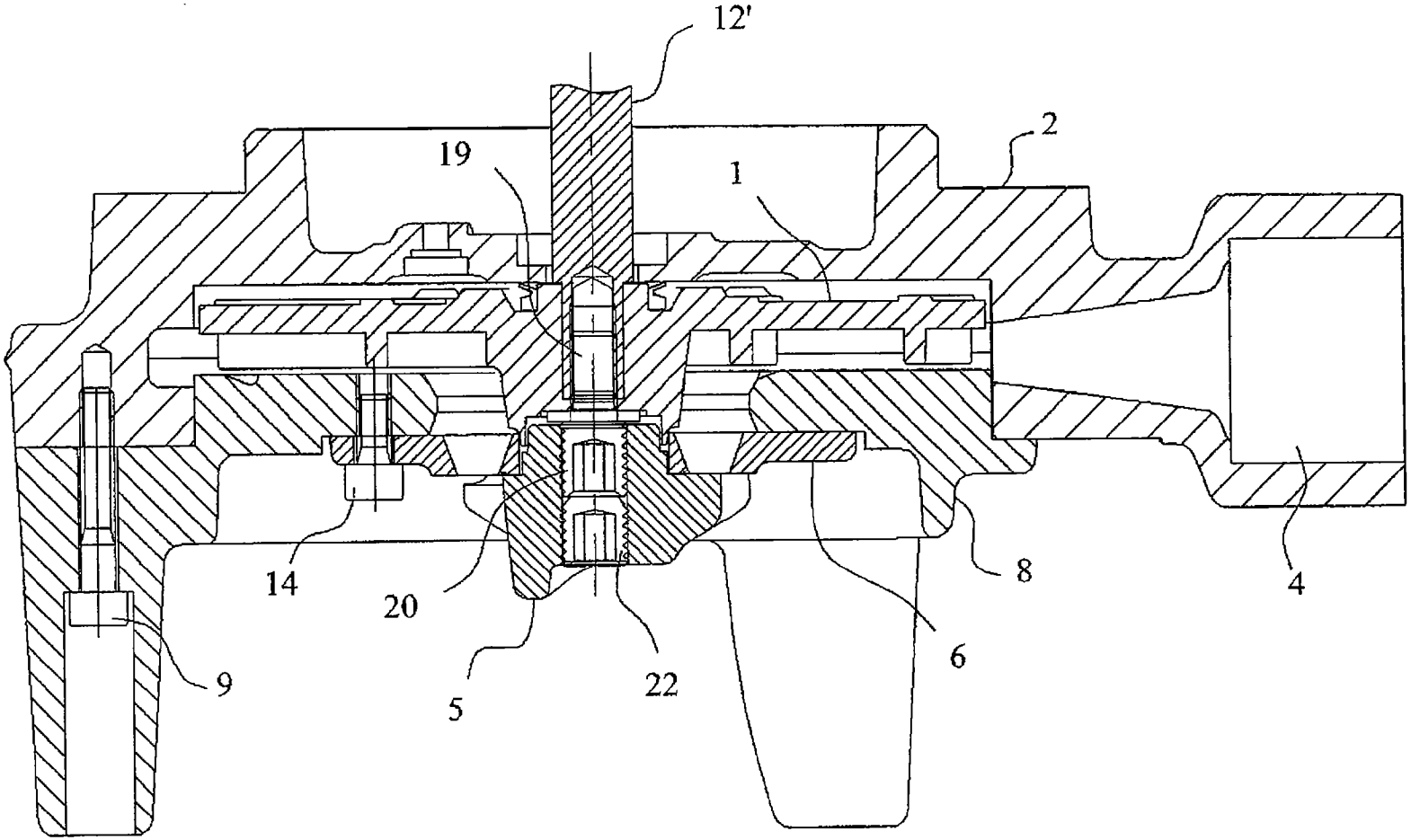
FIG. 3 is a sectional view showing the pump components of FIG. 2 as assembled.

Assembly of the pump components into a state that is illustrated in FIG. 3 commences by mounting the pump wheel 1 onto the end 15 of drive shaft 12', including insertion of the bolt 19 into the shaft's end bore 16. Next, the suction plate 8 is bolted to the pump housing, followed by bolting the cutting plate 6 to the upstream side of the suction plate. Then the cutting wheel 5 is inserted on the bolt head 20 until the cutting edges 10 of cutting wheel 5 contacts the opposite face of cutting plate 6. In a final step, the stop screw 22 is inserted in the central bore 21 until it abuts the opposite end face of bolt head 20. The abutting ends of stop screw 22 and bolt head 20 may advantageously be machined for a full circumferential contact.

A minimum and in all mounting procedures reproducible clearance between cutting wheel and cutting plate is finally established by applying a torque to the stop screw 22, while the cutting wheel being non-rotationally arrested. In result of the stop screw 22 engaging the internal thread of the cutting wheel and abutting the end face of the drive shaft, or the end face of the drive shaft extension in terms of the bolt head 20, the stop screw will exert a separating axial force that eliminates any play in the threaded engagement between the cutting wheel and the bolt head. The cutting wheel is thus forced axially away from the cutting plate, to a minimum and micrometer sized clearance that satisfies an appropriate shearing interaction between the two elements. Obviously, setting of the axial clearance between cutting wheel and cutting plate as disclosed does not affect the axial setting of the pump wheel.

The torque that is needed can be applied manually by means of a torque meter wrench. The size of the clearance is determined solely by the characteristics of the threads in question, and can be re-established at any time and is thus re-producible in maintenance and repair, and is also not depending on operator's skill. In dependence of pump size and application, standardized thread designs in sizes of about M6 to M16 will provide operative clearances without need for modification of thread parameters. In a moderate sized pump for waste water transport, an M12 sized thread may be preferred. In other applications and pump sizes, thread design parameters such as thread lead, thread profile, side clearances, etc., may need modification in order to provide the axial play in the threaded engagement which, when eliminated as advised, results in the desired axial clearance between the cutting wheel and the cutting plate. Such modification of thread cutting parameters is however well known to a person who is skilled in thread cutting.

Modifications to the detailed design of illustrated components are possible within the scope of the claimed solution, for which reason the same details, which are also not part of the invention, are not further commented on.

One feasible modification within the scope of invention includes, e.g., a drive shaft end which extends through the bottom of blind bore 17. In such embodiment, the pump wheel is axially securable on the drive shaft by means of, e.g., a nut in threaded engagement with a thread that is formed externally on the projecting shaft end, onto which also the cutting wheel is mountable in threaded engagement. Alternatively, the drive shaft end may be mounted flush, or substantially flush, with the pump wheel face, in which case the pump wheel is secured axially on the drive shaft by means of the above said bolt onto which the cutting wheel is mountable in threaded engagement. In embodiments wherein the drive shaft end projects through the pump wheel, axial support may be provided through formations such as shoulders formed on the drive shaft, and if appropriate further enhanced through washer members inserted on the shaft. Such modification may be suitable and advantageous in connection with pump wheels made from synthetic materials, e.g.

It should be pointed out that the use of an stop screw as an adjusting element for the cutting wheel is preferred, but the adjusting element may be any other element capable of applying a separating axial force on the cutting wheel and on the drive shaft in order to eliminate the axial play in the threaded engagement between the cutting wheel and the drive shaft.

One further embodiment of the adjusting element may be constituted by a wedge shaped pin. In this embodiment the cutting wheel comprises a through hole extending lateral to the length extension of and across the central through bore 21 of the cutting wheel. Thereto the through hole is located at a height extension of the cutter wheel, at which the drive shaft will terminate upon installation of the cutting wheel on the drive shaft. The wedge shaped pin is insertable in the through hole and will then abut the end face of the drive shaft. Upon further insertion of the pin it will apply a separating axial force on the cutting wheel and on the drive shaft, and thereby eliminating the axial play in the threaded engagement between the cutting wheel and the drive shaft. When the pin is fully inserted an optimal axial clearance is establish at the shearing interface between the cutting wheel and the cutting plate.

Other embodiments of the adjusting element are conceivable as well. The adjusting element may be an element that engages the internal thread of the cutting wheel without presenting an external thread of its own. For instance the adjusting element may use an eccentric tightening device which is inserted into the through bore 21 of the cutting wheel 5 in order to abut the end face of the drive shaft. Upon actuation of the eccentric tightening device, the body thereof or special means thereof may expand and engage with the internal thread of the cutting wheel, and the body or special means will expand in the axial direction as well and thereby a force will act on the end face of the drive shaft. Thereby a separating axial force is exerted by the adjusting element on the cutting wheel and on the drive shaft. When the eccentric tightening device is fully actuated an optimal axial clearance is establish at the shearing interface between the cutting wheel and the cutting plate.

Although the invention is illustrated in relation to a centrifugal pump with radial discharge, the claimed solution may obviously be used also in a pump which is designed for an axial discharge of liquid.

The invention claimed is:

1. A pump assembly comprising a cutting wheel mounted on a drive shaft in coaxial and co-rotational relation with a pump wheel, and a cutting plate stationary mountable in a pump housing between the cutting wheel and the pump wheel, the cutting plate having perforations forming passages there through for a liquid to be transported by the pump wheel in rotation, the cutting wheel and cutting plate in co-operation providing a shearing interface effective for cutting solid matter which may be entrained in the liquid, wherein the cutting wheel has an internal thread engaging an external thread on the drive shaft, the pump assembly further comprises an adjusting element, which is arranged to establish an axial clearance at the shearing interface between the cutting wheel and the cutting plate by applying a separating axial force on the cutting wheel and on the drive shaft and thereby eliminating an axial play in the threaded engagement between the cutting wheel and the drive shaft.

2. The pump assembly of claim 1, wherein the separating axial force is applied from a stop screw engaging the internal thread of the cutting wheel while abutting an end face of the drive shaft.

3. The pump assembly of claim 1, wherein the internal thread of the cutting wheel engages a thread which is formed externally on an axial extension of the drive shaft.

4. The pump assembly of claim 3, wherein the axial extension of the drive shaft is a threaded bolt which is insertable in the drive shaft end, and which has an external thread formed on the bolt's head.

5. The pump assembly of claim 4, wherein the drive shaft end is insertable into the pump wheel for a splined connection with a blind bore formed in the pump wheel.

6. The pump assembly of claim 5, wherein the bolt is passed through a bottom of the blind bore to effect, by the bolt's head, an axial securing of the pump wheel to the drive shaft end.

7. A method by which an operative shearing action is securable in a chopping pump assembly, the assembly comprising a cutting wheel mounted on a drive shaft in coaxial and co-rotational relation with a pump wheel;

a cutting plate stationary mountable in a pump housing between the cutting wheel and the pump wheel, the cutting plate having perforations forming passages there through for a liquid to be transported by the pump wheel in rotation, the cutting wheel and cutting plate in co-operation providing a shearing interface effective for cutting solid matter which may be entrained in the liquid, the method comprising the steps of:

securing the pump wheel axially on the drive shaft;

mounting the cutting plate stationary to the pump housing;

mounting the cutting wheel in a threaded engagement with the drive shaft end so as to contact the cutting plate, and applying an adjusting element, which is arranged to establish an axial clearance at the shearing interface between the cutting wheel and the cutting plate by applying a separating axial force on the cutting wheel and on the drive shaft and thereby eliminating an axial play in the threaded engagement between the cutting wheel and the drive shaft.

8. The method of claim 7, wherein the step of generating a separating axial force comprises applying a stop screw to engage an internal thread of the cutting wheel while abutting an end face of the drive shaft.

9. The method of claim 7, wherein the pump wheel is axially secured on the drive shaft through a bolt which is inserted in the drive shaft end, and wherein mounting the cutting wheel comprises the step of inserting a head of said bolt for a threaded engagement with an internal thread formed on the cutting wheel.

10. The method of claim 7, wherein the separating axial force is generated by applying a torque to the stop screw while arresting the cutting wheel non-rotationally.

* * * * *